US009988888B2

(12) United States Patent
Rey-Bethbeder et al.

(10) Patent No.: US 9,988,888 B2
(45) **Date of Patent: *Jun. 5, 2018**

(54) ELECTRIC FRACTURING OF A RESERVOIR

(71) Applicant: TOTAL S.A., Courbevoie (FR)

(72) Inventors: Franck Rey-Bethbeder, Lacq (FR); Justin Martin, Pau (FR); Thierry Reess, Billère (FR); Antoine Sylvestre De Ferron, Bernadets (FR)

(73) Assignee: Total SA, Courbevoie (FR)

( * ) Notice: Subject to any disclaimer, the term of this patent is extended or adjusted under 35 U.S.C. 154(b) by 655 days.

This patent is subject to a terminal disclaimer.

(21) Appl. No.: 14/404,181

(22) PCT Filed: Jun. 3, 2013

(86) PCT No.: PCT/EP2013/061407

§ 371 (c)(1),
(2) Date: Nov. 26, 2014

(87) PCT Pub. No.: WO2013/178826

PCT Pub. Date: Dec. 5, 2013

(65) Prior Publication Data

US 2015/0167438 A1 Jun. 18, 2015

(30) Foreign Application Priority Data

Jun. 1, 2012 (FR) ..... 12 55132

(51) Int. Cl.

| | |
|---|---|
| ***E21B 43/26*** | (2006.01) |
| ***E21B 36/00*** | (2006.01) |
| *E21B 33/124* | (2006.01) |

(52) U.S. Cl.
CPC ..... *E21B 43/26* (2013.01); *E21B 36/001* (2013.01); *E21B 33/124* (2013.01)

(58) Field of Classification Search
CPC ..... E21B 36/001; E21B 43/26
See application file for complete search history.

(56) References Cited

U.S. PATENT DOCUMENTS

| | | | | |
|---|---|---|---|---|
| 4,074,758 | A | 2/1978 | Scott | |
| 4,135,579 | A * | 1/1979 | Rowland | E21B 43/26 166/248 |
| 4,164,978 | A | 8/1979 | Scott | |
| 4,651,311 | A | 3/1987 | Owen et al. | |
| 4,706,228 | A | 11/1987 | Owen et al. | |
| 5,106,164 | A | 4/1992 | Kitzinger et al. | |
| 2001/0011590 | A1 | 8/2001 | Thomas et al. | |

(Continued)

*Primary Examiner* — Giovanna C. Wright
*Assistant Examiner* — Kristyn A Hall
(74) *Attorney, Agent, or Firm* — Harness, Dickey & Pierce, P.L.C.

(57) ABSTRACT

A device is proposed for fracturing a geological hydrocarbon reservoir, including two packers defining a confined space therebetween in a well drilled in the reservoir, an apparatus for regulating the temperature of a fluid in the confined space, a pair of two electrodes arranged in the confined space, and an electric circuit to generate an electric arc between the two electrodes. The circuit includes at least one voltage source connected to the electrodes and an inductor coil between the voltage source and one of the two electrodes. This allows improved fracturing of the reservoir.

19 Claims, 10 Drawing Sheets

(56) References Cited

U.S. PATENT DOCUMENTS

| | | | | |
|---|---|---|---|---|
| 2004/0060735 | A1* | 4/2004 | Beckman | E21B 43/117<br>175/4.6 |
| 2009/0044945 | A1 | 2/2009 | Willberg et al. | |
| 2009/0294121 | A1* | 12/2009 | Leon | E21B 43/26<br>166/248 |
| 2012/0279713 | A1 | 11/2012 | Leon et al. | |
| 2014/0008072 | A1 | 1/2014 | Rey-Bethbeder et al. | |
| 2014/0008073 | A1 | 1/2014 | Rey-Bethbeder et al. | |

* cited by examiner

ELECTRIC FRACTURING OF A RESERVOIR

CROSS-REFERENCE TO RELATED APPLICATIONS

This application is a National Phase Entry of International Application No. PCT/EP2013/061407, filed on Jun. 3, 2013, which claims priority to French Patent Application Serial No. 1255132, filed on Jun. 1, 2012, both of which are incorporated by reference herein.

BACKGROUND AND SUMMARY

The present invention concerns a device and method for fracturing a geological reservoir of hydrocarbons, a method for producing hydrocarbons and a method for calibrating the device.

For the production of hydrocarbons the permeability and/or porosity of the constituent material of the reservoir has an influence on the production of hydrocarbons, and in particular on production rate and profitability. This is notably recalled in the article "Porosity and permeability of Eastern Devonian Shale gas" by Soeder, D. J., published in SPE Formation Evaluation, in 1988, vol. 3, n° 1, pp. 116-124, which reports on the study of eight samples of Devonian shale gas in the Appalachian Basin. This article explains in particular that the production of this shale gas encounters difficulty due to the low permeability of the reservoir (i.e. the constituent material of the reservoir).

Various techniques are available to facilitate hydrocarbon production rates, in particular in a scarcely permeable and scarcely porous reservoir. These techniques entail the static or dynamic fracturing of the reservoir.

Static fracturing relates to the targeted dislocation of the reservoir using the injection of a fluid under very high pressure intended to split the rock. Fracturing is obtained by mechanical "stress" provided by hydraulic pressure obtained by means of a fluid injected under high pressure from a wellbore drilled on the surface. The terms "frac jobs", "frac'ing" or more generally "fracking" are used, or "massive hydraulic fracturing". U.S. Patent Publication No. 2009/044945 in particular describes a static fracturing method such as described above.

Static fracturing has the disadvantage that the fracturing of the reservoir is generally unidirectional. Therefore only the hydrocarbon contained in the portion of reservoir around a deep, highly localised fissure can be produced more rapidly.

To obtain more diffuse splitting, dynamic fracturing, or electric fracturing, has been introduced. For electric fracturing, an electric arc is generated in a well drilled in the reservoir (typically the production well). The electric arc induces a pressure wave which fractures the reservoir in all directions around the wave and therefore increases the permeability of the reservoir.

Several documents report on electric fracturing. For example U.S. Pat. No. 4,074,758 presents a method whereby an electro-hydraulic shock wave is generated in a liquid in the wellbore for better oil recovery. U.S. Pat. No. 4,164,978 suggests having the shock wave followed by an ultrasound wave. U.S. Pat. No. 5,106,164 also describes a method for generating a plasma explosion to fracture the rock, but for a hole of shallow depth and for a mining application and not for the production of hydrocarbons. U.S. Pat. Nos. 4,651,311 and 4,706,228 present a device for generating an electric discharge with electrodes in a chamber containing an electrolyte wherein the electrodes are not subject to erosion by the discharge plasma. Document WO 2009/073475 describes a method for generating an acoustic wave in a fluid medium contained in a well using a device comprising two electrodes between an upper packer and a lower packer defining a confined space. This document describes that the acoustic wave is held in "non-shockwave" state to improve fracturing, without explaining however the differences between "ordinary" acoustic wave and "shock" wave.

None of these documents produces fully satisfactory fracturing of the reservoir. There is therefore a need for improved fracturing of a hydrocarbon reservoir.

For this purpose, a fracturing device is proposed to fracture a geological hydrocarbon reservoir wherein the device comprises two packers defining therebetween a confined space in a well drilled in the reservoir, apparatus for regulating the temperature of a fluid in the confined space, a pair of two electrodes arranged in the confined space and an electric circuit to generate an electric arc between the two electrodes. The circuit comprises at least one voltage source connected to the electrodes and an inductor coil between the voltage source and one of the two electrodes.

According to examples, the device may comprise one or more of the following characteristics:

- the temperature regulating apparatus regulates the temperature of the fluid to optimise the energy yield of the pre-discharge phase when generating an electric arc;
- the temperature regulating apparatus holds the temperature of the fluid at a value between 45 and 67° C., preferably higher than 50° C. and/or lower than 62° C.;
- the device further comprises apparatus for regulating the pressure of the fluid substantially at atmospheric pressure;
- the temperature regulating apparatus comprises a fluid cooling system;
- the inductor coil has adjustable inductance, preferably between 1 μH and 100 mH, more preferably between 10 μH and 1 mH;
- the distance between the two electrodes is adjustable, preferably between 0.2 and 5 cm, more preferably between 1 and 3 cm;
- the voltage source comprises a capacitor having a capacitance higher than 1 μF, preferably higher than 10 μF;
- the capacitance of the capacitor is adjustable, preferably lower than 1000 μF, more preferably lower than 200 μF;
- the circuit further comprises a Marx generator and ferrites forming a saturable inductor on a pathway leading the capacitor directly to the inductor, the ferrites being saturated once the Marx generator is discharged;
- the capacitor is separated from the inductor by a spark gap primed by a pulse generator;
- the electrodes have a radius between 0.1 mm and 50 mm, preferably between 1 mm and 30 mm;
- the device comprises a release system; and/or
- the device comprises several pairs of electrodes.

A fracturing method is also proposed to fracture a geological reservoir of hydrocarbons. The method comprises electric fracturing of the reservoir by generating an electric arc with the above circuit and simultaneously regulating the temperature of a fluid in the confined space of the device. A hydrocarbon production method is also proposed comprising the fracturing of a geological reservoir of hydrocarbons using the above method.

Also proposed is a method to calibrate the temperature regulating apparatus of the above device. The calibrating method comprises the steps of providing the device, determining a pre-breakdown voltage over and above which the electric arc is generated, measuring a breakdown voltage at the terminals of the electrodes and a breakdown time as a function of the temperature of the fluid, by applying the pre-breakdown voltage and causing the temperature of the fluid to vary, then inferring from the preceding step the energy yield of the pre-discharge phase as a function of the temperature, and defining a target temperature or temperature range for the temperature regulating apparatus as a function of the maximum energy yield inferred at the preceding step.

BRIEF DESCRIPTION OF THE DRAWINGS

Other characteristics and advantages of the invention will become apparent on reading the following detailed description of embodiments of the invention given solely as examples and with reference to the drawings which illustrate.

DETAILED DESCRIPTION

Figure 1:
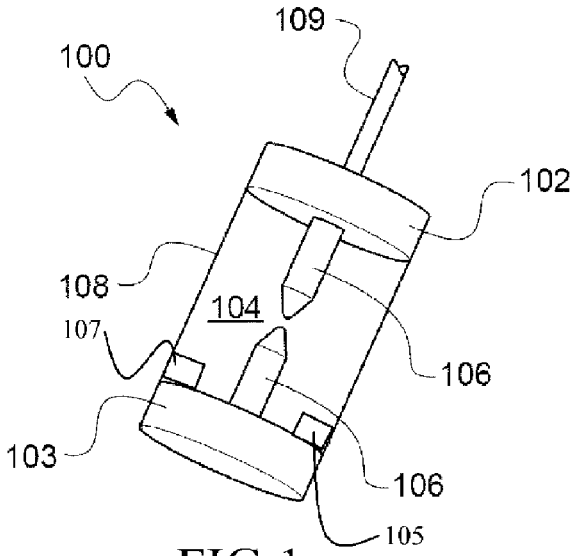
FIGS. 1 to 4, examples of the device.

There is proposed a device for fracturing a geological reservoir of hydrocarbons. The device comprises two packers defining therebetween a confined space in a well drilled in the reservoir (i.e. designed to be confined at least when the device is installed in a well drilled in the reservoir). The device comprises apparatus for regulating the temperature of a fluid in the confined space. The device comprises a pair of two electrodes arranged in the confined space. And the device further comprises an electric circuit (configured/adapted/designed) to generate an electric arc between the two electrodes. The circuit comprises at least one voltage source connected to the electrodes and an inductor coil between the voltage source and one of the two electrodes.

With the device it is possible to fracture a hydrocarbon reservoir in improved manner. In particular, the device allows the generating of an electric arc between the two electrodes and thereby to conduct electric fracturing of the reservoir when the device is positioned in a wellbore drilled in the reservoir. The inductor coil allows an electric arc to be obtained that gives rise to a pressure wave thereby obtaining improved fracturing of the reservoir. The temperature regulating apparatus allows temperature adjustment and thereby the obtaining of the temperature allowing a pressure wave to be produced which leads to good fracturing of the reservoir.

The expression "electric arc" designates an electric current set up in an insulating medium. The generation of the electric arc induces a "pressure wave", i.e. a mechanical wave which, along its pathway, subjects the medium through which it passes to a pressure. The generation of the electric arc allows more diffuse/multidirectional fracturing of the reservoir than obtained with static fracturing. The generation of the electric arc therefore causes micro-fissures in all directions around the position of the electric arc, and thereby increases the permeability of the reservoir typically by a factor of 10 to 1000. In addition, this increase in permeability is obtained without using means to prevent closing of the micro-fissures such as the injection of proppant. Additionally, electric fracturing does not require considerable energies or major quantities of water. There is therefore no need for a recycling system for water in particular.

It is therefore possible to access the hydrocarbon contained in the reservoir that can only be accessed with difficulty when using static fracturing. The combination of static fracturing and electric fracturing therefore allows improved global fracturing of the reservoir.

The electric arc is preferably generated in a fluid contained in a well drilled in the reservoir. The pressure wave originating from the electric arc is therefore transmitted with less attenuation. The wellbore contains fluid which is typically water. In other words, when electric fracturing successively follows after a drilling process, the drilled well may automatically fill with water contained in the reservoir. Potentially if the wellbore does not fill automatically it can be artificially filled.

A description will be given of the device before describing the electric fracturing method. However, reference will be made to the method when describing the device and evidently the different operating functions of the device (i.e. the different actions it permits) can be integrated in the method even if not reproduced in the description of the method.

The circuit comprises at least one inductor coil between the voltage source and the electrode with which it is connected. The inductor coil is a component which induces a time delay of the current relative to the voltage. The value of inductance is expressed in Henry units. The inductor coil may optionally be wound around a core in ferromagnetic material or ferrites. The inductor coil is also known as a "self", "solenoid", or "self-inductor". Inductance attenuates the current front in the circuit. This makes it possible to obtain a slower rise time of the pressure wave and hence a pressure wave which better penetrates the reservoir. Fracturing of the reservoir is therefore deeper. In particular the inductance may be higher than 1 μH or 10 μH, and/or lower than 100 mH or than 1 mH.

The packers can be designed to follow the contour of the wellbore wall, generally cylindrical, thereby defining therebetween a confined space. Alternatively, or in addition, the device may comprise a membrane which delimits the confined space. The membrane may be hermetic (or impervious) and rigid. This makes it possible to separate the pressure prevailing in the confined space from the surrounding pressure, for example the hydrostatic pressure of the wellbore if it is flooded (e.g. subsequent to hydraulic fracturing). The membrane is then preferably in a material adapted for good conducting of the pressure waves, to optimise electric fracturing. Therefore the fluid may be a fluid (e.g. water) present in the wellbore or else already contained in the device before use. In this latter case the fluid may be demineralised water (e.g. of conductivity $\sigma$=40 μS/cm). This allows an increase in the value of the equivalent resistance of the enclosure and hence limits breakdown energies. An orifice can be provided in the device to renew the water.

By "confined" is meant that the confined space is designed so that the temperature prevailing therein can be modified by means of the temperature regulating apparatus and optionally so that the pressure prevailing therein can also be modified optionally using pressure regulating apparatus to regulate the pressure of the fluid in the confined space (e.g. the pressure regulating apparatus comprises a pump, e.g. a pump to increase the pressure of the fluid). This or these adjustments allow optimisation of the fluid contained in the confined space to promote the onset of an electric arc between the two electrodes and/or so that the electric arc obtained gives rise to a good pressure wave in relation to the conditions of the reservoir or type of fluid.

Therefore "confinement" may, but does not necessarily, mean total closure and similarly the seal may be but is not necessarily a complete seal.

The temperature regulating apparatus is apparatus which holds (at least approximately) the temperature of the fluid at the target value or within a target range. Therefore the temperature regulating apparatus may comprise a thermostat. The target can be predetermined or calculated, optionally as a function of input values e.g. values originating from measurements, e.g. of fluid pressure. In particular the target can be adapted to the conditions of the reservoir and/or fluid in the confined space and/or the characteristics of the fracturing device and/or fluid so as to obtain the "best" temperature or "best" temperature range as a function of these conditions and/or characteristics. The temperature regulating apparatus may therefore comprise a temperature sensor and/or control unit with a processor coupled to a memory recording the target or a programme allowing calculation of the target. Additionally, the temperature regulating apparatus may comprise a system for heating the fluid and/or a system to cool the fluid to carry out adjustment. These different components are known to those skilled in the art.

By "best" temperature or "best" temperature range is meant the temperature(s) which, given the characteristics of the device and of the fluid, and the pressure of the fluid, allow the obtaining of a pressure wave (subsequent to generation of the electric arc) leading to deeper and/or more diffuse fracturing. Further to tests, in particular those presented below, it was surprisingly found that said temperature optimum does exist whereas it could be surmised that the more the fluid draws close to its boiling point, whilst remaining below this point, the better the fracturing obtained. The temperature regulating apparatus therefore allows adjustment of the temperature around a target, for example well below the boiling point of the fluid, and the unexpected obtaining of improved fracturing.

In particular, the temperature regulating apparatus can (can be designed to) adjust the temperature of the fluid to optimise the energy yield of the pre-discharge phase at the time the electric arc is generated The energy yield of the pre-discharge phase is the ratio (or measurement proportional to this ratio) between the electric energy needed to initiate the pressure wave induced by the electric arc and the electric energy provided by the experimental device (this electric energy being determined by the size of the device). The higher the energy yield of the pre-discharge phase the more there "remains" available energy, after the pre-discharge phase, for the discharge phase itself, which translates as a pressure wave with better performance. In other words, the target is chosen to optimise this measurement (at least approximately).

For example this can be achieved using a calibrating method (i.e. configuration prior to use) of the temperature regulating apparatus of the device. The device can first be provided, e.g. under real conditions in the well, or by reproducing in a laboratory the fluid pressure at which it is envisaged to use the device (in other words the fluid is also provided). It is also possible to determine a pre-breakdown voltage of the device (i.e. the voltage threshold applied between the electrodes over and above which the electric arc is generated). This can be achieved in different manners, one manner being explained below when presenting the tests, in particular with reference to FIGS. 11 to 17. Next the breakdown voltage at the terminals of the electrodes can be measured (i.e. the voltage at the electrode terminals needed to initiate the electric arc) and the breakdown time (i.e. the length of time the voltage must be applied to initiate the electric arc) as a function of the temperature of the fluid (i.e. the temperature is varied to carry out the different measurements). To do so the pre-breakdown voltage (previously determined) is applied and the fluid temperature is caused to vary. It is then possible to infer from the preceding step the energy yield of the pre-discharge phase as a function of temperature (one way to perform this step is discussed below in particular with reference to FIGS. 11 to 17). Finally a target temperature or temperature range can be defined for the temperature regulating apparatus as a function of (tallying with) a maximum energy yield inferred at the preceding step.

In one example, the temperature regulating apparatus may hold the temperature of the fluid at a value between 45 and 67° C., preferably higher than 50° C. and/or lower than 62° C. These temperature values of the fluid in the confined space allow an energy yield of the pre-discharge phase to be obtained that is higher than 80% at atmospheric pressure. Therefore the device is appropriately provided with apparatus to regulate the pressure of the fluid adapted to regulate the fluid pressure substantially at atmospheric pressure.

As previously indicated, the temperature regulating apparatus may comprise a fluid cooling system. This provides for better use of the device, in particular to remain at optimum temperature. Each electric arc generated raises the temperature to above the target through the release of heat; the water must therefore be cooled on and after the generation of a certain number of electric arc generations to remain at the optimum temperature.

The device may be mobile along the wellbore and is fixed before generating an electric arc. For example the device may comprise moving means, e.g. via radio guidance. The device can then be powered by a high voltage supply located on the surface and connected to the device via electric cables along the wellbore. The device may also comprise a release system. This makes it possible to leave the device in the wellbore if it is blocked. It is then possible to recover the well and/or drill string.

The device may be of general elongate shape allowing easier movement thereof inside the well. The device may also comprise several pairs of electrodes over a distance. The electrodes can be powered by several storage capacitors. This allows quicker fracturing. Several electric arcs can then be generated at the same time between each pair of electrodes, and several fracturing operations performed at the same time.

The device may comprise a system to inject a chemical additive which includes a storage vat to store the additive and a pump to inject the additive into the confined volume when using the device. The heating apparatus may comprise a hot fluid source and a conveying duct, the duct having an opening in the vicinity of the electrodes so that when the device is in operation the hot fluid can be conveyed from the source to the electrodes. The conveying duct may cross over one or both electrodes. These different characteristics allow optimising of conditions to promote the onset of an electric arc.

Other potential characteristics of the device for fracturing a geological hydrocarbon reservoir will now be presented with reference to FIGS. 1 to 4 which illustrate a device 100 forming an example of the device for fracturing a geological hydrocarbon reservoir presented above. The device 100 in FIG. 1 comprises two packers 102 and 103 defining the confined space 104 therebetween. The confined space 104 here is also delimited by the membrane 108. The device 100 also comprises the two electrodes 106 arranged in the confined space 104. The two electrodes 106 in the example are respectively connected to the voltage source via an input 109 and to ground 103 (here merged with the packer 103) of the circuit, which allows the formation of the electric arc between the two electrodes 106. The electrodes may have a radius of between 0.1 mm and 50 mm, preferably between 1 mm and 30 mm. The input 109 may be an insulated cable.

FIG. 1 also schematically shows the fluid temperature regulating apparatus 105 in the confined space and the pressure regulating apparatus 107. The electric circuit for generating an electric arc between the two electrodes 106, its voltage source and the inductor are not illustrated but may conform to FIGS. 2 to 4 which schematically illustrate examples of the device 100.

Figure 2:
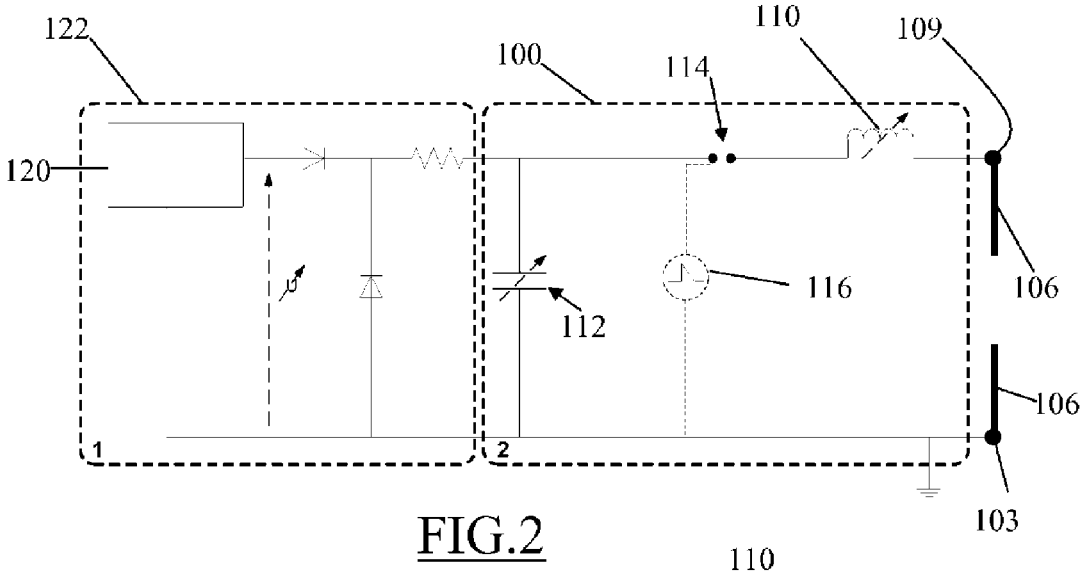

The device 100 in FIG. 2 comprises the inductor coil 110. The voltage source comprises the capacitor 112. As can be seen in the schematic in FIG. 2, when the capacitor 112 is discharged an electric arc can be formed between the electrodes 106. The capacitor may have a capacitance higher than 1 μF, preferably higher than 10 μF. The capacitance allows energy to be reached leading to the onset of a subsonic arc.

The electric discharge is said to be "subsonic" or "supersonic" depending on its speed of formation. A "subsonic" discharge is typically associated with thermal processes: the arc propagates through gas bubbles created by heating of the water. The term "slow" propagation is used for the electric discharge, typically in the order of 10 m/s. The chief characteristics of a subsonic discharge are related to the high energies involved (typically above several hundred Joules), to thermal processes associated with a long voltage application time and to low voltage levels (weak electric field). With this discharge mode the pressure wave propagates in a large volume of gas before propagating in the fluid. A "supersonic" discharge is typically associated with electronic processes. The discharge propagates in water without any thermal process, with filamentous appearance. The term "rapid" propagation is used for the electric discharge, in the order of 10 km/s. The characteristics of a supersonic discharge are related to the low energies involved, to high voltages associated with a short application time, and to strong electric fields (MV/cm). For this discharge mode the thermal effects are negligible. Since the discharge cannot develop directly in the liquid phase, the notion of microbubbles can be taken into consideration to explain the development of this discharge mode. The volume of gas entailed is smaller than for subsonic discharges.

The capacitor 112 may have a capacitance of less than 1000 μF, preferably lower than 200 μF. The capacitor 112 is separated from the inductor by a spark gap 114 primed by the pulse generator 116. This provides control over the discharges of the capacitor 112 and therefore over the pressure waves generated by the electric arc. In particular, the pulse generator 116 can be configured for repeat waves as described below.

The voltage source (i.e. the capacitor 112) is charged by a High Voltage charger 120 provided in the auxiliary circuit 122 to a voltage U of between 1 and 500 kV, preferably between 50 and 200 kV. The auxiliary circuit is preferably positioned on the surface and can therefore be separated from the device.

Figure 3:
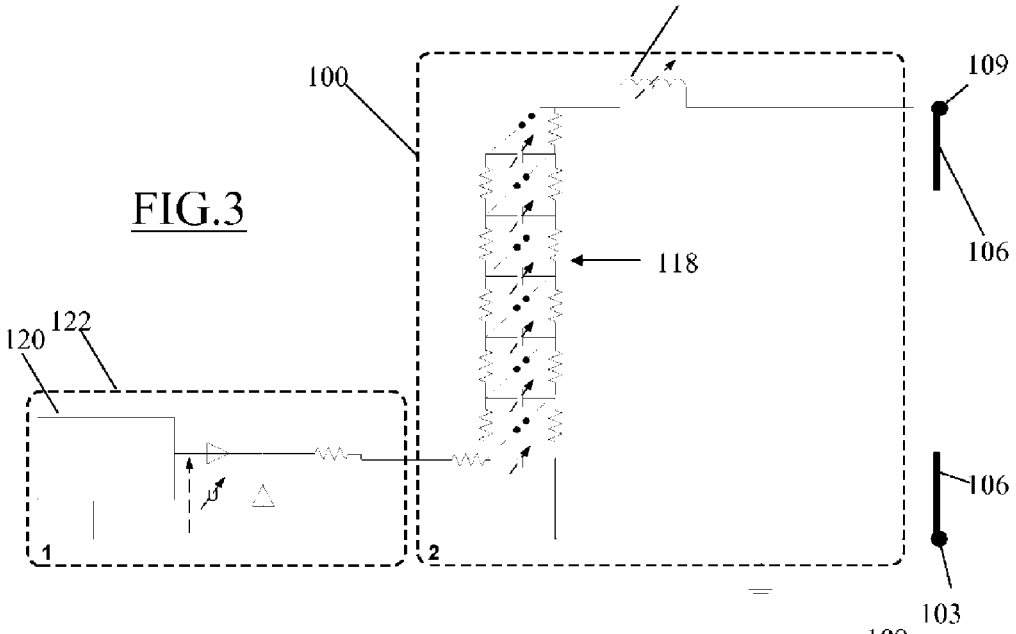

The device 100 in FIG. 3 differs from the example in FIG. 2 in that a Marx generator 118 replaces the capacitor 112 and the (spark gap 114+pulse generator 116) assembly. The Marx generator 118 at the time of its discharging allows the creation of a supersonic electronic arc by imposing a higher voltage than the capacitor 112.

Figure 4:
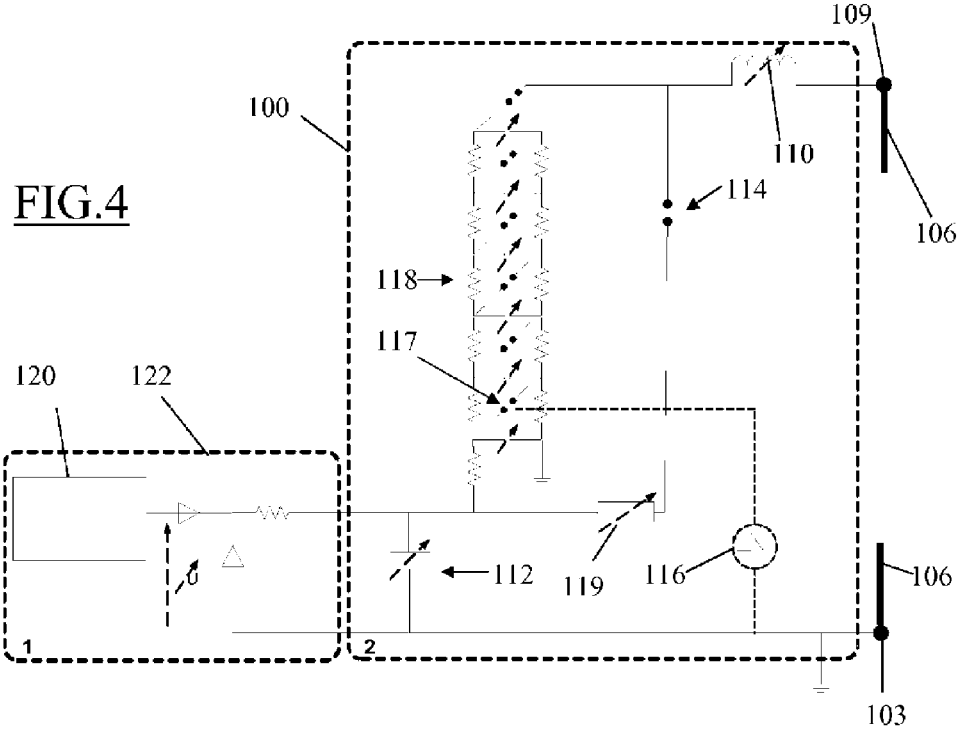

In the device 100 in FIG. 4, the voltage source comprises the capacitor 112 in FIG. 2 and the Marx generator 118 in FIG. 3. However, the pulse generator 116 primes the first spark gap 117 of the Marx generator 118. The device 100 further comprises the ferrites 119 forming a saturable inductor on the pathway leading the capacitor directly to the inductor. The ferrites 119 are configured to be saturated once the Marx generator 118 is discharged. Once the ferrites 19 are saturated, only the capacitor 112 discharges. This allows temporary insulation of the capacitor 112 and hence the changeover (i.e. switching) of a supersonic arc to a subsonic arc. The device therefore ensures coupling between a supersonic and subsonic discharge. Said combination of the two supersonic and subsonic modes provides for improved electro-acoustic yield and hence improved fracturing with lesser electric force. The subsonic discharge produced by the capacitor 112 occurs after a delay corresponding to the breakdown time of the Marx generator 118. Switching can take place within a time shorter than 1 s. Typically, the duration of the discharge produced by the Marx generator 118 is very short, lasting less than 1 microsecond and with an amplitude greater than 100 kV.

In the three examples in FIGS. 2 to 4 and as indicated in the Figures, the different components of the device 100 have adjustable characteristics i.e. their characteristics can be modified before use in relation to the reservoir, or during use in relation to the response or progress of fracturing. For example the coil 110 may have adjustable inductance. The characteristics of the Marx generator 118 (capacitance of each capacitor in parallel, number of capacitors in operation) can be adjusted. The distance between the electrodes 106, preferably between 0.2 and 5 cm, more preferably between 1 and 3 cm, can also be adjusted. The capacitance of the capacitor 112 can also be adjusted. This makes it possible to obtain a device 100 adapted to the fracturing of any type of reservoir. It is effectively not necessary to replace the device 100 when changing the reservoir to be fractured (and when the material is different) since it is sufficient to modify one or more adjustable parameters. This also allows optimised fracturing by modifying, optionally remotely, the parameters currently being used.

Figure 5:
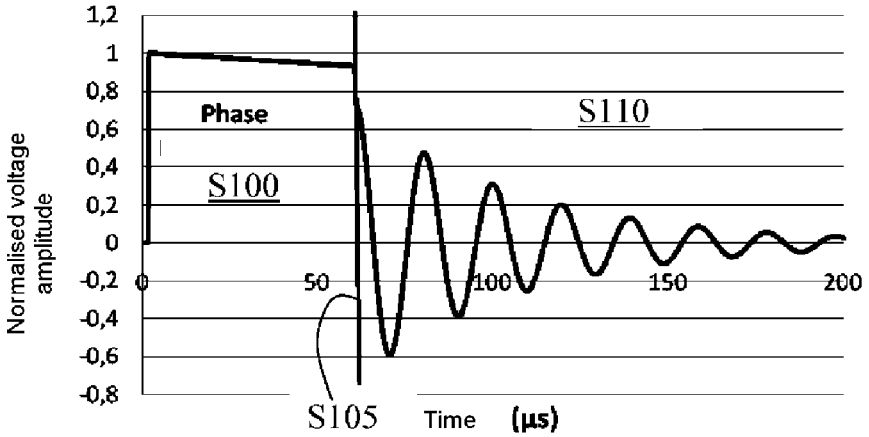
FIGS. 5 to 17, examples of measurements.

The explanations given above will now be illustrated by theoretical developments and tests described with reference to FIGS. 5 to 17 relating in particular to the device 100 in FIGS. 1 to 4. First the improved fracturing through the presence of the inductor coil is discussed with reference to FIGS. 5 to 10. With reference to FIG. 5 showing the normalised amplitude of the voltage at the terminals of the capacitor 112, the generation of the pressure wave can be broken down into two phases: a pre-discharge phase S100 and a post-discharge phase S110, separated by the onset S105 of the arc.

During the pre-discharge phase S100, the voltage drops. This drop corresponds to the discharge of the equivalent capacitance of the energy bank or Marx generator in the equivalent resistance of the device 100. The greater the equivalent resistance, the better the energy in the pre-breakdown phase is maintained. The electrode configuration in each case (subsonic or supersonic) can therefore allow the obtaining of the least possible energy loss. This corresponds to optimisation of water heating in one case and of the electric field in the other case.

During the discharge phase S110, the electric circuit can be modelled by an RLC circuit in oscillating mode. The equation for current changes in a series RLC circuit is given below:

$$i(t) = \frac{U_B}{Lw}\exp^{-\frac{Rt}{2L}}\sin(wt) \quad (1)$$

$$\text{With } w = \sqrt{\frac{1}{LC}\left(\frac{R}{2L}\right)^2} \quad (2)$$

With $U_B$ which is the voltage at the time of dielectric rupture of the water. The parameters L, C and R are respectively the inductance, capacitance and resistance of the circuit. This current i(t) is a function of the breakdown voltage $U_B$ (dielectric rupture of the medium) of the circuit capacitor, inductor and resistor.

Experiments allowed the evidencing of the linearity of the peak pressure generated as a function of the maximum current at the time of dielectric rupture of the water in the two breakdown modes. An example of results is given in FIGS. 6 and 7 which show the peak pressure measurements obtained as a function of the maximum current during the discharge phase S110 and the linear regression of measurements in subsonic and supersonic mode respectively. It can be seen that, for a similar peak current, the pressure is higher for a discharge of "supersonic" type. This can be partly attributed to the processes generating the electric arc in water and to the volume of gas between the electric arc and the liquid contained in the inter-electrode space.

Additional experiments evidenced the influence of the inter-electrode distance on the peak value of the pressure wave generated in the two modes of dielectric rupture. The length of the electric arc appeared to have a direct influence on pressure. The greater the inter-electrode distance the more the pressure peak value appeared to be higher as shown in the graph in FIG. 8.

Some experiments examined the influence of the geometry of the electrodes on the pressure wave. The results are given in FIG. 9. They allowed the conclusion to be drawn that the shape of the electrodes used to generate the pressure wave does not appear to have an influence on the pressure peak value. On the other hand it can minimise electrical losses before the onset of the electric arc.

A pressure sensor was used to visualise the pressure wave shapes generated in relation to the frequency spectrum. This frequency spectrum may be modified by the dielectric rupture mode, by the parameters of the electric circuit, by the volume of gas, and by the type of liquid used. Two examples of a frequency spectrum associated with a discharge in subsonic and supersonic mode were tested. It appeared that the greater the number of low frequencies in the spectrum the less fracturing is diffuse.

Figure 10:
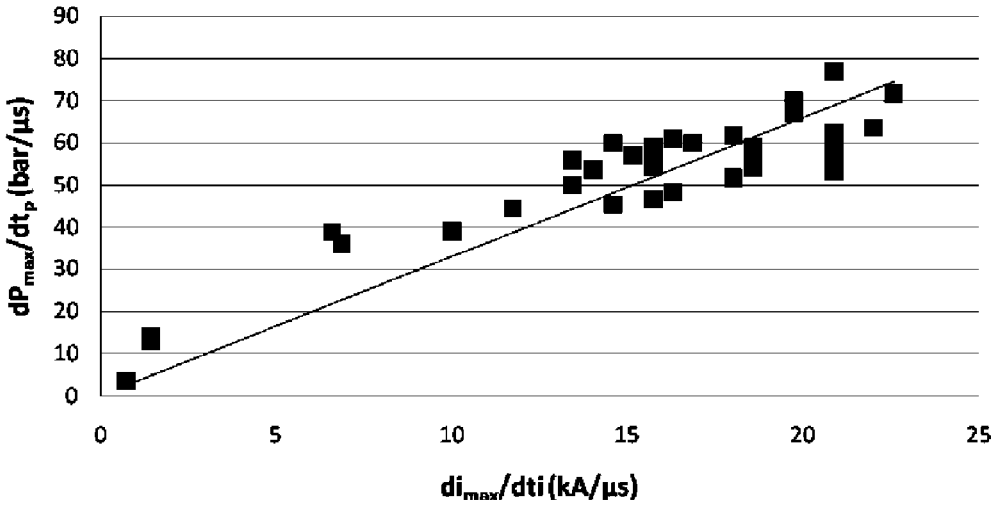
Figure 11:
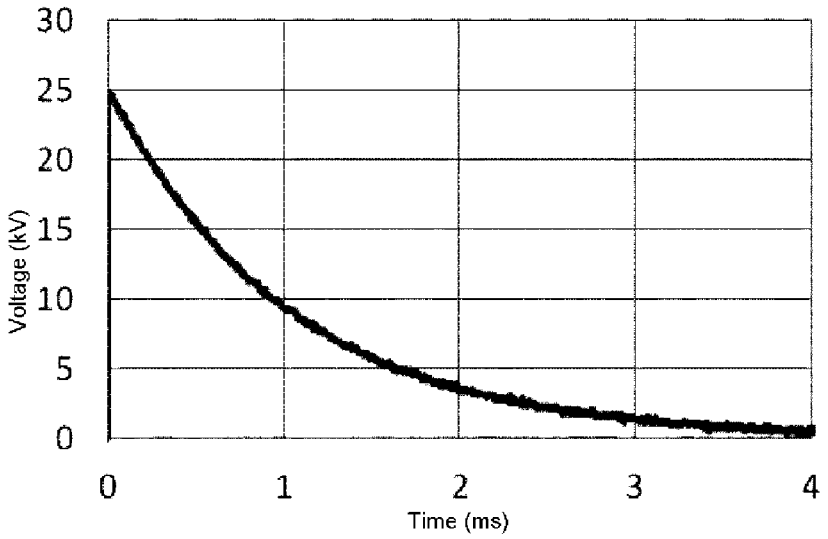

The result of various experiments conducted evidences a linear relationship $dP_{max}/dt_p$ as a function of the current front $di_{max}/dt_i$, illustrated in FIG. 10. The current front has an influence on the pressure front. The slower the current front the more pressure is low frequency. The studies conducted also clearly demonstrated an accumulated fracturing effect in relation to the number of shocks. The notion of pulse recurrence therefore appears to be a criterion having an influence on fracturing.

The placing in equation form of the above-indicated principles will now be discussed.

Calculation of peak current denoted $i_{max}$:

To calculate the current $i_{max}$, the following conditions are written:

$$\text{if } \sin(wt) = 1 \text{ and } wt = \frac{\pi}{2}$$

-continued $$\text{then } i(t) = i_{max} \text{ with } t = \frac{\pi}{2w}$$

Using the equations (1) and (2):

$$i_{max} = \frac{U_b}{Lw}\exp^{-\frac{R\pi}{4Lw}} \quad (3)$$

$$T_{front} = \frac{\pi}{2\sqrt{\frac{1}{LC}\left(\frac{R}{2L}\right)^2}} \quad (4)$$

If the value of w is approximated (R of very low value):

$$w = \frac{\pi}{2\sqrt{\frac{1}{LC}\left(\frac{R}{2L}\right)^2}} \approx \frac{1}{\sqrt{LC}} \quad (5)$$

$$i_{max} = U_b\sqrt{\frac{C}{L}}\exp^{-\frac{R\pi}{4}\sqrt{\frac{C}{L}}} \quad (6)$$

$$T_{front} \approx \frac{\pi\sqrt{LC}}{2} \quad (7)$$

Energy equation:

$$E_b = \frac{1}{2}CU_b^2 \text{ hence } U_b = \sqrt{\frac{2E}{C}} \quad (8)$$

With $E_b$ denoting energy and $U_b$ the voltage at the time of the electric arc.

By replacing equation (8) in (3):

$$i_{max} = \sqrt{\frac{2E_b}{L}}\exp^{-\frac{R\pi}{4}\sqrt{\frac{C}{L}}} \quad (9)$$

The peak current $i_{max}$ is controlled by the energy available at the time of the arc denoted $E_b$ and by the inductance of the circuit L; it is on these two parameters that the user must act. The resistance R is considered to be very low and the capacitance C is a function of energy $E_b$.

Figure 6:
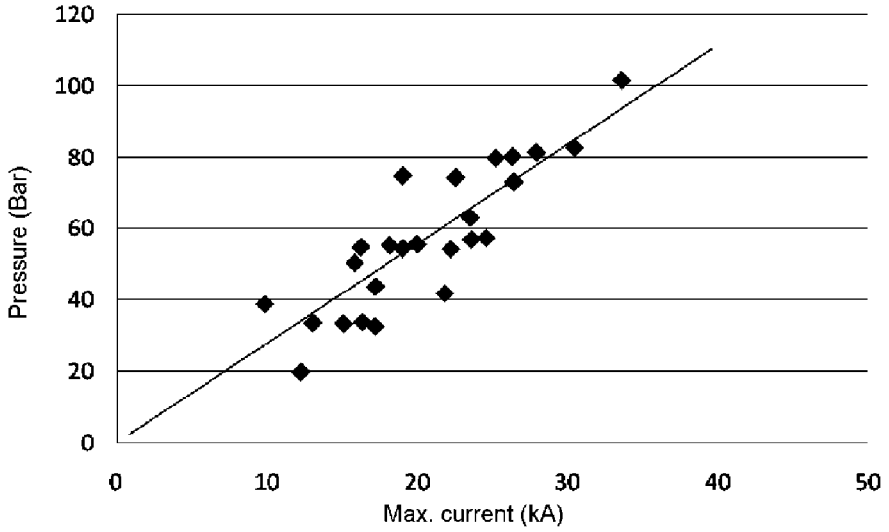
Figure 7:
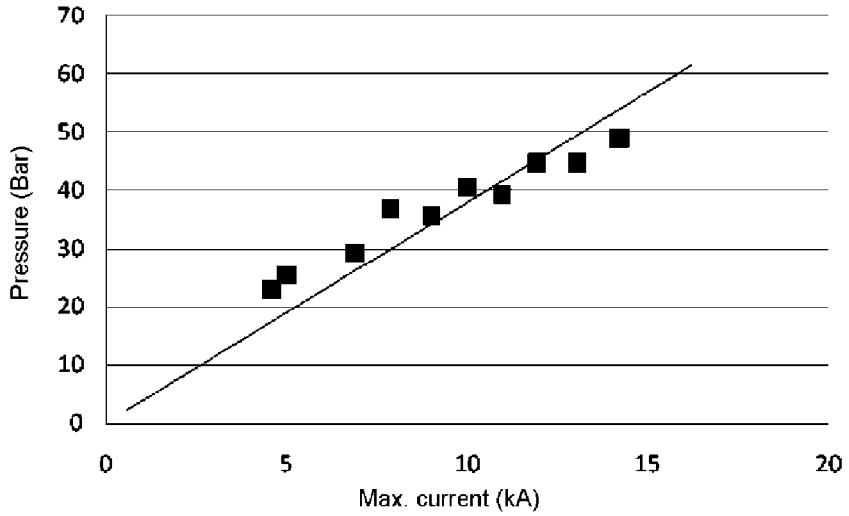
Figure 8:
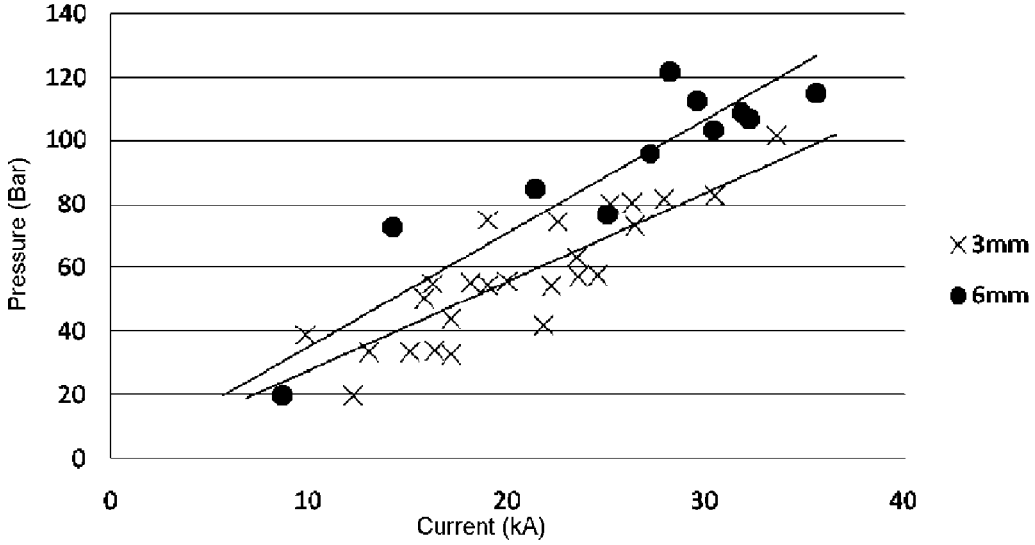
Figure 9:
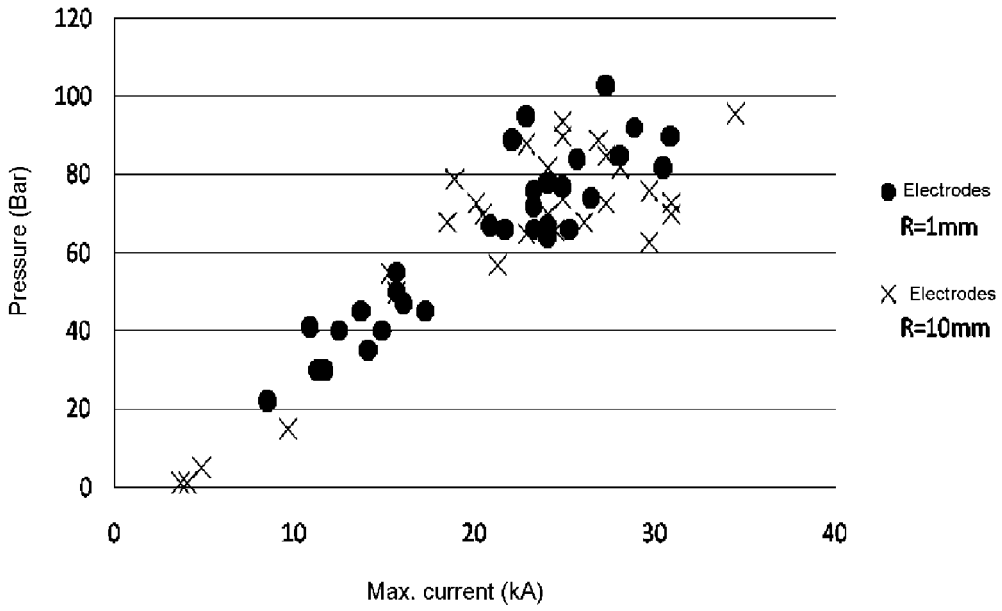

Relationship Between Peak Pressure and Maximum Current:

On the basis of the results set forth in FIGS. 6, 7 and 9 the following expression can be inferred:

$$P_{max}=k_1 I_{max} \quad (10)$$

with $k_1$ a function of the inter-electrode distance and of breakdown mode.

The greater inter-electrode distance the higher the coefficient $k_1$

Hence:

$$I_{max} = \frac{P_{max}}{k_1} \quad (11)$$

By replacing equation (11) in (9):

$$\frac{P_{max}}{k_1} = \sqrt{\frac{2E_b}{L}} \exp^{-\frac{R\pi}{4}\sqrt{\frac{C}{L}}} \tag{12}$$

$$P_{max} = k_1\sqrt{\frac{2E_b}{L}} \exp^{-\frac{R\pi}{4}\sqrt{\frac{C}{L}}} \tag{13}$$

The generated peak pressure is therefore controlled by the current $I_{max}$ (parameters $E_b$ and L) and by the coefficient $k_1$ (a function of inter-electrode distance and dielectric rupture mode of water). It is therefore possible to act upon $E_b$, L and $k_1$ to obtain the desired pressure.

Relationship between $dP_{max}/dt_p$ as a function of $di_{max}/d_t$:

According to FIG. 10, the following expression can be inferred:

$$\frac{dP_{max}}{dt_p} = k_2\frac{di_{max}}{dt_i} \tag{14}$$

with $k_2$ a function of inter-electrode distance and of breakdown mode.

The coefficient $k_2$ corresponds to physical electro-acoustic coupling.

Using the equations (11) and (14):

$$k_1\frac{di_{max}}{dt_p} = k_2\frac{di_{max}}{dt_i} \tag{15}$$

$$dt_p = \frac{k_2}{k_1}dt_i \tag{15}$$

$$dt_p = \frac{k_2}{k_1}\frac{\pi\sqrt{LC}}{2} \tag{18}$$

The front of the pressure wave is therefore controlled by the coefficients $k_1$ and $k_2$ and by the values of L and C (parameters of the electric circuit).

Therefore, to summarise these studies, it is observed that:

In both breakdown modes the maximum pressure wave, resulting from dielectric rupture of water, is chiefly dependent on the value of the maximum current denoted $i_{max}$.

This value of the peak current is a function of the breakdown voltage and of the impedances of the electric circuit. When the configuration of the circuit is imposed, one way to optimise the current is to increase the breakdown voltage of the range. This amounts to maximising the electric energy switched in the medium.

When the circuit is not imposed but the switched electric energy is maintained constant, the amplitude of the pressure wave is optimised by reducing the impedance of the circuit.

The form of current injection, the dielectric rupture mode and type of liquid have an influence on the dynamics of the pressure wave. These dynamics and the acoustic yield of the device can also be modified by injecting artificial bubbles and using the "double pulse" method (subsonic and supersonic).

The injected current being constant, the value of the pressure peak is higher in supersonic mode than in subsonic mode.

The injected current being constant, the value of the pressure peak is higher the longer the inter-electrode distance.

The geometry of the electrodes, the injected current being constant, does not have an influence on the generated pressure peak but may play a role in reducing electric losses during the pre-discharge phase.

To conclude, the above studies confirm the usefulness of adding an inductor between the voltage source and one of the two electrodes to act on the pressure wave that is finally generated. The studies also confirm the advantage of having adjustable parameters e.g. inductance, capacitor capacitance, the characteristics of the Marx generator. Since the pressure wave is dependent upon these parameters the possibility that these can be adjusted provides control over the pressure wave.

The improvement in fracturing by means of regulating the temperature is now discussed with reference to FIGS. 11 to 17 which illustrate tests evidencing this improvement. An enclosure was developed and built to re-create in a laboratory the thermodynamic conditions of a liquid under well-bore conditions.

The electrode configuration is composed of two pointed electrodes (radius of curvature 2.5 mm) and an inter-electrode distance of 3 mm. Demineralised water ($\sigma$=40 μS/cm) was used to increase the value of the equivalent resistance of the enclosure and thereby to limit breakdown energies. The water was renewed after each series. The insulating material used for High Voltage passing was PEEK 450G.

With the objective of limiting the energy injected into the enclosure, the tests were conducted with a bank of capacitors of equivalent capacitance C=600 nF. The charge voltage of these capacitors could not exceed 40 kV. The maximum electric energy was therefore about 500 J which, given the geometry of the electrodes used, guaranteed discharge propagation via subsonic mode.

The dielectric strength of water is characterized by determination of the pre-breakdown voltage $U_{50}$, a voltage value which causes 50% holds and 50% priming. The method used allowing determination of this voltage $U_{50}$ is called the "up and down" method. Voltage levels are preselected and a series of tests is conducted at these different levels, the result of each test determining the following level: immediately higher level in the event of a hold, immediately lower level in the event of priming. Around fifty tests are sufficient to acquire the value $U_{50}$. In all the curves illustrated the value denoted $U_{50}$ therefore presents the mean of a series of 50 shocks.

Given the complex geometry of the cell, COMSOL software was used to estimate the value of inter-electrode capacitance for each experimental configuration. The results give a capacitance of 125 pF for D=1.5 mm and 120 pF for D=3 mm. The values of equivalent capacitance of the HP cell (High Pressure) are in the order of one hundred pico Farad. In our case the storage capacitance was of high value being 600 F (subsonic discharge): transfer of capacitance was therefore optimal.

The equivalent resistance of water was determined using an experimental method and simulation using COMSOL software. At the time of discharge of a capacitor in water, there is a so-called pre-discharge phase during which the voltage drops. This drop corresponds to discharge of the capacitance in the equivalent resistance of the inter-electrode device. This equivalent resistance is called $R_{water}$. For a subsonic discharge, $R_{water}$ is determined by measuring the exponential decay of the voltage wave, as illustrated in FIG.

11. The value of the discharge constant corresponds to the time needed for a 37% drop in the initial voltage value of the capacitor.

For a conductor, at a given temperature, there is an equation which can be used to calculate its resistance as a function of its dimensions and of its constituent material (here water):

$$R = \rho\frac{L}{s} \text{ with } \rho = \frac{1}{\sigma}$$

Where: ρ: Resistivity of water (Ω·m)

σ: Conductivity of water (S/m)

Since the conductivity of water is a function of its temperature, we can define the changes thereof, for the type of water we used in our experiments, using the following equation:

$$\sigma=\sigma_0(1+a(T-T_0))$$

Where: $\sigma_0$: Initial conductivity (S/m)

a: Temperature coefficient $T_0$: Reference temperature (° K)

It is important to note that changes in the conductivity of water as a function of temperature are not the same depending on the type of water used (pure, demineralised, tap water or sea water for example). Initial conductivity determines the influence of temperature on later changes in conductivity. In our case we used demineralised water and the initial parameters were determined experimentally.

Using the COMSOL electrothermal coupling module, the resistance was able to be determined using Ohm's law. To do so an electric potential at the HT electrode was pre-determined as was the conductivity of the water (defined by the preceding equation). COMSOL allows calculation of the value of the current by integrating total current density on the surface of the water contained in the enclosure, and hence determination of the value of equivalent resistance $R_{water}$.

The changes in $R_{water}$ over a range of absolute static pressure of 0 to 15 bars is: 1750Ω for 0 bar, 1683Ω for 5 bars, 1706Ω for 10 bars, and 1833Ω for 15 bars. Analysis of these results allows the conclusion to be drawn that static pressure apparently has no influence on the resistance $R_{water}$.

Figure 12:
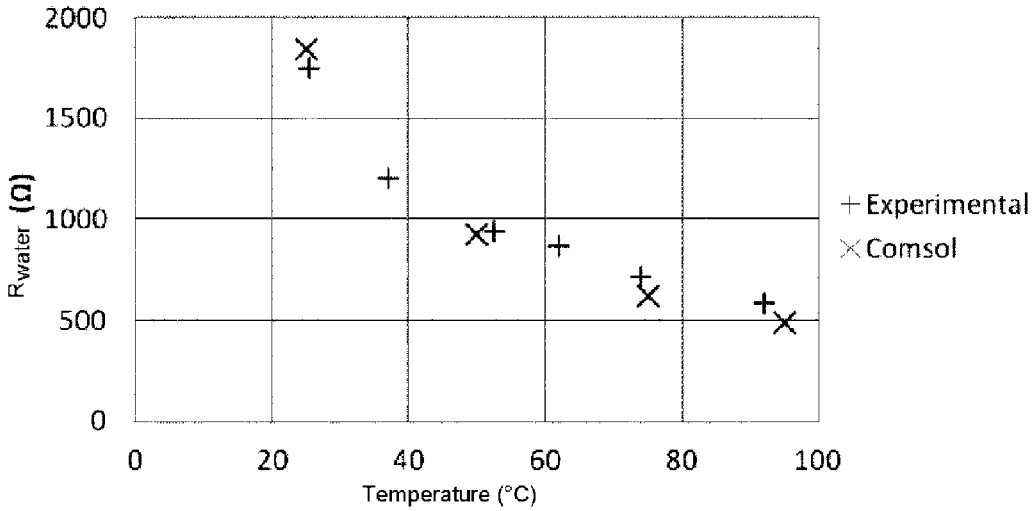
Figure 13:
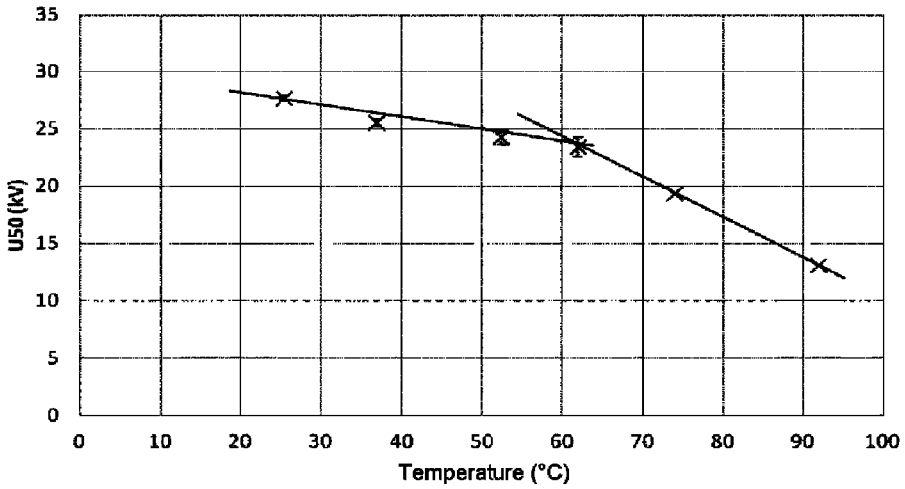

The experimental and simulation results on the influence of water temperature on resistance $R_{water}$ are given in FIG. 12. The curves obtained show the large influence of temperature on the equivalent resistance of the enclosure. From 25° C. to 95° C. the value of resistance is divided by a factor of 3.

The objective of this part of the simulation tests was to characterize the HP enclosure in terms of voltage hold and equivalent impedance (capacitance and resistance). The obtaining of these fundamental parameters allows prediction of the wave form likely to be obtained on the load (here our HP cell) for an applied voltage (and hence energy), an electrode geometry and under well-determined water thermodynamic conditions. These parameters are of major interest for our study since capacitance and equivalent resistance define energy transfer from the storage capacitor to the cell.

The dielectric strength of water was then characterized as a function of its thermodynamic parameters, and the influence of these parameters was examined on the dynamics of the pressure wave. One experimental protocol studied the changes in voltage $U_{50}$ as a function of water temperature, at atmospheric pressure. These results are given in FIG. 13.

It was determined that thermal processes play a predominant role in the pre-discharge phase of the subsonic mode since the electric arc is developed in gas bubbles created vaporisation of water. It therefore follows that a reduction in disruptive voltage is observed as and when the temperature increases. However this tendency is clearly enhanced as soon as the temperature exceeds about 60° C. When T°<°60° C., a 100% increase in temperature leads to a decrease of less than 10% in the value of $U_{50}$ whereas when T°<60° C., one same variation in temperature translates as a decrease of about 60% in $U_{50}$. In general, for electric discharges, a said slope change is associated with a change in discharge mode. The problem here is more complex since it involves thermodynamic phenomena related to the liquid phase-water vapour transition.

Since the energy of water vaporisation decreases when T increases, the question can be raised whether from an energy viewpoint electric losses are minimised by this increase in temperature (it is recalled that the acoustic energy of the pressure wave is directly dependent on electrothermal losses during the pre-breakdown phase). To answer this question, the energy consumed $E_c$ in the pre-breakdown phase can be defined by:

$$E_C = \int_0^{T_b} p(t)\cdot dt = \int_0^{T_b} \frac{u^2(t)}{R_{water}}\cdot dt$$

where:

p(t): electric power u(t): applied voltage $R_{water}$: equivalent resistance of water $T_b$=: moment of breakdown $$\text{However } u(t) = U_{50}\cdot\exp\left(\frac{-t}{R_{water}\cdot C}\right) \tag{1}$$

$$\text{therefore } E_C = \frac{1}{2}\cdot C\cdot U_{50}^2\cdot\left\{1-\exp\left(-\frac{T_b}{2R_{water}C}\right)\right\}$$

The total electric energy $E_T$ initially stored is expressed by:

$$E_T = \frac{1}{2}\cdot C\cdot U_{50}^2 \tag{2}$$

Electrothermal losses related to heating are therefore defined by:

$$\text{Losses} = \frac{E_C}{E_T} = \left\{1-\exp\left(-\frac{T_b}{2R_{water}C}\right)\right\} \tag{3}$$

The yield of the pre-discharge phase is expressed by:

$$\eta=(1-\text{Losses})\times 100 \tag{4}$$

The expressions (1), (2), (3) and (4) are therefore dependent on the three parameters $U_{50}$, $T_b$ and $R_{water}$. The equivalent resistance $R_{water}$ of the test enclosure is determined experimentally from the exponential decay of the applied voltage illustrated in FIG. 12. The results can be summarised in the following Table:

| Temperature (° C.) | 25.5 | 37 | 52.5 | 62 | 74 | 92 |
|---|---|---|---|---|---|---|
| $R_{water}$ | 1750 | 1200 | 942 | 867 | 717 | 583 |

Figure 14:
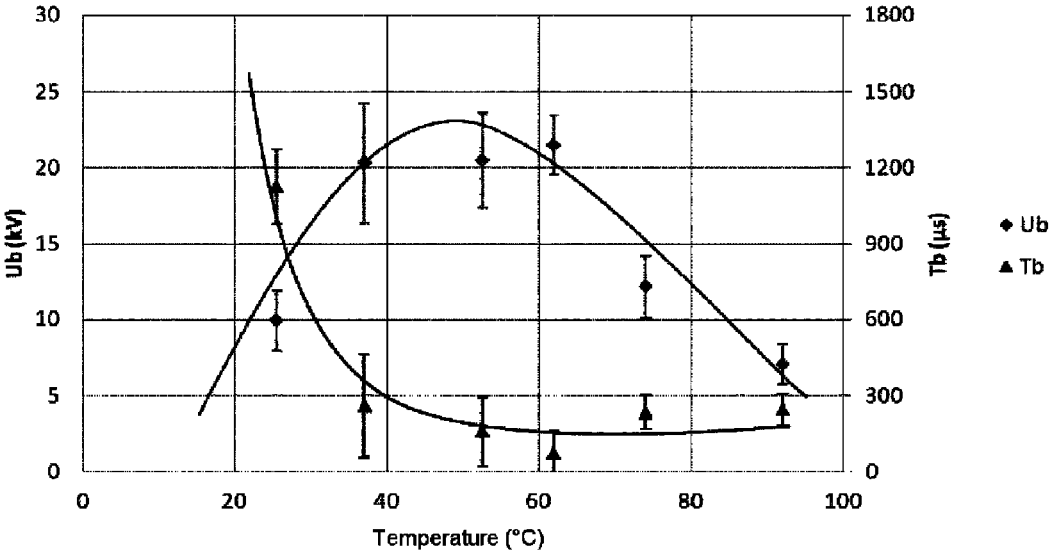

FIG. 14 shows the changes in breakdown voltage $U_b$ and corresponding time $T_b$ as a function of water temperature, and standard deviations. When the temperature increases we know that the value of $R_{water}$ decreases, thereby leading to a reduction in the time length of application of the voltage wave. It therefore follows that a decrease in the parameter $T_b$ is observed when temperature increases.

The interpretation of the variation in parameter $U_b$ is more difficult. It takes into account the small variation of $U_{50}$ over the range 25° C.-60° C. coupled with a significant decrease in the length of application time of the voltage wave. The voltage $U_b$ therefore increases over this temperature range. Over and above this temperature range the breakdown voltage is significantly reduced when the temperature increases from 60° C. to 90° C. Since the voltage application time is further reduced, the breakdown voltage $U_b$ can only decrease.

Figure 15:
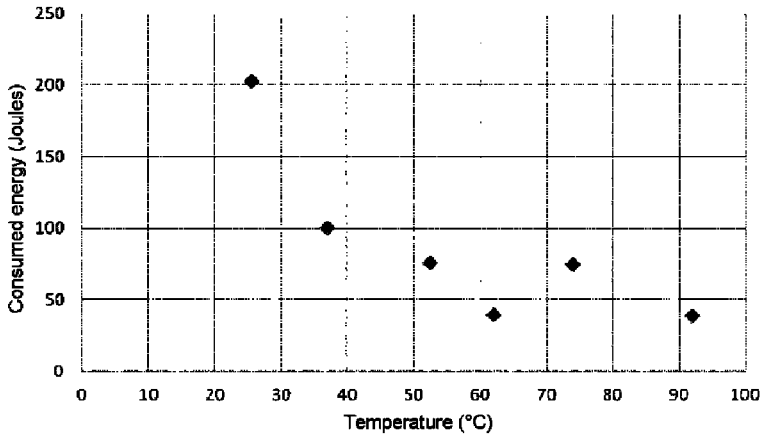

All the parameters defined in expression (1) are then determined experimentally. It is hence possible to plot the curve of changes in consumed energy $E_c$ during the pre-discharge phase as a function of temperature as illustrated in FIG. 15.

The energy consumed to create the electric arc decreases with temperature. To interpret this result, it can be assumed that the most part of this energy is consumed to create the gas phase (hypothesis largely verified by the fact that a few tens of milli-joules are sufficient to initiate an electric arc in air at atmospheric pressure over millimetric distances). The energy required (at constant atmospheric pressure) to vaporise a mass of water initially at temperature $T_i$ is given by the expression:

$$E=m\cdot c_p\cdot(T_f-T_i)+H \quad (5)$$

Where: H enthalpy of vaporisation per unit mass $c_p$ isobaric heat capacity/unit mass at temperature $T_i$ The enthalpy of vaporisation per unit mass is constant at a pressure of 1 bar and the variations in $c_p$ as a function of temperature are given in the water Tables. Therefore the variations in E given by expression (5) show that the more the temperature increases the less energy is needed to vaporise a unit mass of water, as illustrated in FIG. 16.

Therefore, the decrease in energy consumed by the pre-discharge phase with the increase in temperature can be interpreted, in simplified manner, in terms of vaporisation energy. It is probable that this explanation is insufficient and that other parameters are involved in this energy balance. In particular, to complete this energy balance, changes in the volume of the bubbles as a function of temperature appears to be a parameter of importance (the curve in FIG. 16 was obtained at constant mass hence at constant volume for all temperatures).

Figure 16:
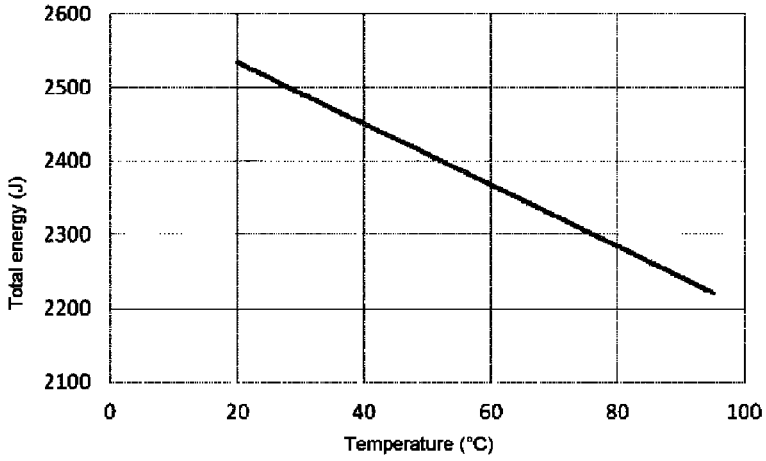

It is also to be noted that the curve given in FIG. 16 was plotted using the breakdown voltage $U_{50}$ obtained for each temperature. It is the minimum energy required by phenomena to initiate the electric arc. This therefore means that if the initially stored energy $E_T$ is fixed by charging the capacitor bank to a constant voltage, then the surplus energy ($E_T$–$E_C$) available for the post-discharge phase increases with temperature.

Figure 17:
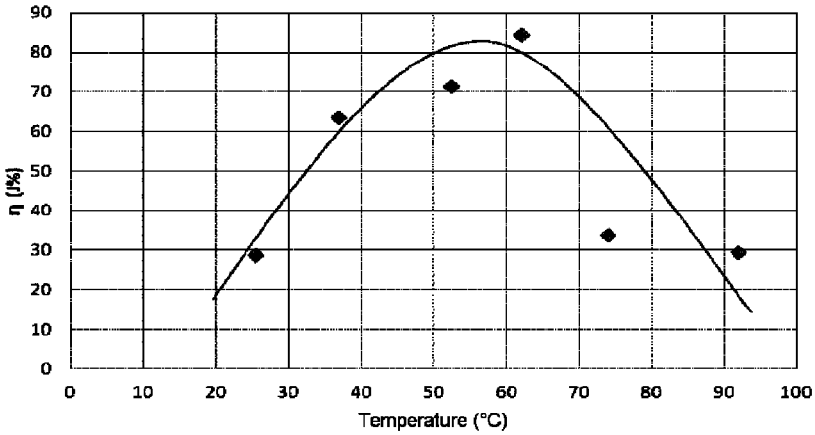

Let us now turn to the energy yield of the pre-discharge phase as a function temperature, as illustrated in FIG. 17. The experimental results show that the yield of pre-discharge exhibits an optimum at a temperature of between 45 and 67° C., or more specifically higher than 50° C. and/or lower than 62° C. This optimum yield chiefly results from the slope change of the curve $U_{50}$=f(T) at T>60° C. whereas consumed energy remains near-constant.

At T≈60° C., about 80% of energy is available for the post-discharge phase of which part which will be converted to acoustic energy. Only 30% of the initial energy is available for the post-discharge phase if the water temperature is fixed at T=25° C. This result is therefore of great interest for the objective of optimising the electro-acoustic yield of the electric fracturing method.

The above study illustrated in FIGS. 11 to 17 therefore shows the advantage of regulating the temperature of the fluid in the confined space in order to improve energy yield and cause a pressure wave, the dimensions of the device being fixed, allowing improved fracturing.

As mentioned previously, the fracturing device can be used in a fracturing method to fracture a geological hydrocarbon reservoir. The method comprises the electric fracturing of the reservoir by generating an electric arc with the device, which gives rise to a pressure wave leading to fracturing. Simultaneously, the method may comprise the regulation of the temperature of a fluid in the confined space of the device by means of the temperature regulating apparatus. The device can therefore also be used for a hydrocarbon production method comprising the fracturing of a geological hydrocarbon reservoir using the preceding method.

Figure 18:
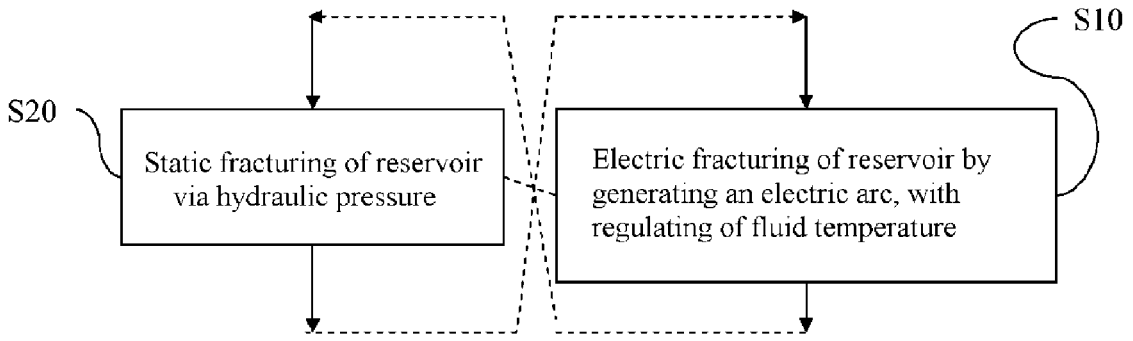
FIGS. 18 to 20, schematics illustrating proposed fracturing methods.

With reference to FIG. 18, a method for fracturing a geological hydrocarbon reservoir is also proposed. The method in FIG. 18 comprises static fracturing (S20) of the reservoir via hydraulic pressure. And the method in FIG. 18, before, during or after static fracturing (S20) (these three possibilities being illustrated by dotted lines in FIG. 18) also comprises electric fracturing (S10) of the reservoir by generating an electric arc in a wellbore drilled in the reservoir such as described above. The method in FIG. 18 improves reservoir fracturing.

Static fracturing (S20) may be any type of static fracturing known in the prior art. In general static fracturing (S20), optionally after drilling a well in the reservoir, may comprise the injection of a fluid under high pressure into the well. Static fracturing (S20) therefore creates one or more unidirectional fissures, typically deeper than those created by electric fracturing (S10). The fluid may be water, mud or a technical fluid with controlled viscosity filled with hard agents (screened sand grains, or ceramic micro-spheres) which prevent the fracture lines from closing up when the pressure drops.

Static fracturing (S20) may comprise a first injection phase into a wellbore of a fracturing fluid containing thickeners, and a second phase which involves the periodic adding of proppant (i.e. a propping agent) to the fracturing fluid to feed the formed fracture with proppant. In this manner clusters of proppant are formed in the fracture preventing it from closing up and provide channels for the flow of hydrocarbon between the clusters. The second phase or its sub-phases involve the additional adding of a reinforcing and/or consolidating material to the fracturing fluid to increase the strength of the proppant clusters. The static fracturing (S20) typically allows fractures of between 100 and 5000 metres to be obtained.

Static fracturing (S20) may precede electric fracturing (S10). In this case, the pressure wave generated by electric fracturing (S10) can follow the course of the fluid injected in the fissures created by static fracturing (S20) and thereby improve fracturing. Also, the order of fracturing (S20) and (S10) has low leakage risk. For example static fracturing (S20) may precede electric fracturing (S10) by less than one week.

Figure 19:
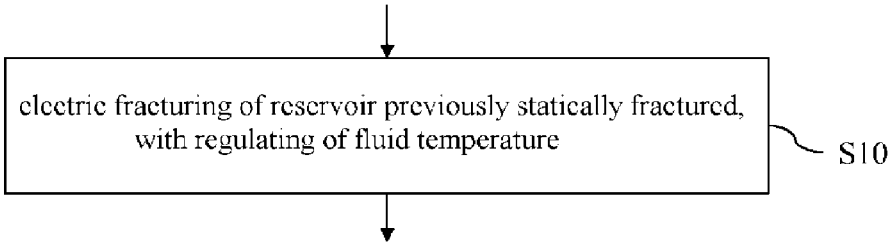

With reference to FIG. 19, there is also proposed a method for fracturing a geological hydrocarbon reservoir previously statically fractured by hydraulic pressure. The method in FIG. 19 only comprises electric fracturing (S10) of the reservoir and is performed in a reservoir in which a well has already been drilled and has already been statically fractured. The method in FIG. 19 allows the fracturing of reservoirs that have already been operated after static fracturing. In other words the method in FIG. 19 allows the operation of a reservoir that has been abandoned after operation thereof, potentially by re-using an already drilled well. It is to be noted that if it is combined with this prior static fracturing, the method in FIG. 19 corresponds to the method in FIG. 18 (where static fracturing (S20) corresponds to this prior static fracturing). Therefore prior static fracturing may have been performed using the method in FIG. 18.

Figure 20:
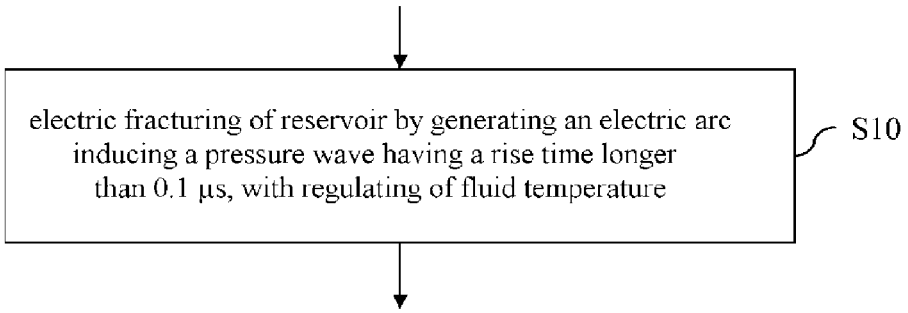

With reference to FIG. 20 a method is proposed for fracturing a geological hydrocarbon reservoir, comprising particular electric fracturing (S10). The electric fracturing (S10) proposed in the method in FIG. 20 can evidently be used for the method in FIG. 18 and/or for the method in FIG. 19. The method in FIG. 20 chiefly comprises electric fracturing (S10) of the reservoir by generating an electric arc in a fluid contained in a well drilled in the reservoir (hence whether or not combined with static fracturing, e.g. static fracturing (S20) of the method in FIG. 1). The electric arc causes a pressure wave whose rise time is longer than 0.1 μs, preferably longer than 10 μs. The method in FIG. 20 improves reservoir fracturing.

The rise time of the pressure wave is the time needed so that the pressure wave reaches the pressure peak i.e. the maximum value of the wave (also called "peak pressure"). In the present case a rise time of more than 0.1 μs, preferably more than 10 μs, corresponds to a pressure wave which better penetrates the reservoir. Said pressure wave is particularly efficient (i.e. the wave penetrates deeper) in materials that are scarcely ductile such as those forming reservoirs of shale gas. Preferably the rise time is shorter than 1 ms, advantageously shorter than 500 μs.

The pressure wave may have a maximum pressure of up to 10 kbar, preferably higher than 100 bar and/or lower than 1000 bar. This can correspond to stored energy of between 10 J and 2 MJ, preferably between 10 kJ and 500 kJ.

Different possibilities applicable to any of the methods in FIG. 18, FIG. 19 or FIG. 20 will now be described. The well may be horizontal. For example, the well may be horizontal and have a length preferably between 500 and 5000 m, advantageously between 800 and 1200 m, for example to a depth of between 1000 and 10000 m, for example between 3000 and 5000 m.

Electric fracturing (S10) can be repeated at different treatment zones along the well. With electric fracturing (S10) the pressure wave generally penetrates less deep than static fracturing. Therefore with electric fracturing (S10) fissures typically of less than 100 m in length are obtained, typically less than 50 m and typically longer than 20 m. For a well that is several hundred metres long, repeat electric fracturing (S10) along the well allows fracturing along the length of the well and hence better possible operation of the reservoir.

Also, in each treatment zone (or single treatment zone if only one) several arcs can be successively generated. Here the generating of an arc electric is repeated at a substantially fixed position. Fracturing is thereby improved by repeating the pressure wave. The generated arcs may be the same or different. For example, at each treatment zone the arcs generated in succession may cause a pressure wave having a decreasing rise time. For example the successive arcs may have an increasingly steeper front thereby inducing a pressure wave having an ever faster rise time. In this case the initial pulses have slower fronts for deep penetration whilst the pulses with steeper fronts fracture at shallower depth and more densely. In this manner fracturing is optimised. The initial arcs for example may induce a pressure wave having a rise time longer than 10 μs, preferably 100 μs. The last arcs may then induce a pressure wave having a rise time shorter than the initial arc, for example shorter than 10 μs or 100 μs. The initial arcs comprise at least one arc, preferably a number lower than 10000 even 1000, and the last arcs comprise at least one arc, preferably a number lower than 10000 even 1000.

In addition, in each treatment zone the arcs can be generated at a frequency lower than 100 Hz, preferably lower than 10 Hz and/or higher than 0.001 Hz, preferably higher than 0.01 Hz. Preferably the frequency of the arcs may be (substantially) equal to the resonance frequency of the material to be fractured in the reservoir. This ensures more efficient fracturing.

The reservoir may have a permeability of less than 10 microdarcy. It may in particular be a reservoir of shale gas. In this type of reservoir, the gas is typically adsorbed (up to 85% on Lewis Shale) and weakly trapped in the pores. With the low permeability of this type of reservoir it cannot be expected to obtain direct production of gases trapped in a said medium, only the surface gas (adsorbed gas) can be produced. Therefore for a reservoir of shale gas where permeability is in the order of one microdarcy, efficient electric fracturing (S10) over a radius of 30 m along a horizontal well of length 1000 m would allow gas recovery possibly exceeding 50 $MNm^3$ (on the assumption of 26 $Nm^3$ of gas per $m^3$ of rock as suggested in the aforementioned article "Porosity and permeability of Eastern Devonian Shale gas"). The fracturing method of any of FIGS. 1 to 3 can therefore be included in a method for producing hydrocarbons from a reservoir, typically a shale gas reservoir.

The generation of the electric arc may induce a temperature gradient generating a pressure wave in the fluid. Electric fracturing (S10) may comprise the prior injection into the fluid of an agent improving the plasticity of the constituent material of the reservoir. The agent may comprise a chemical additive. The chemical additive may be an agent inducing rock fracture. The additive may comprise steam. This further improves fracturing.

Figure 22:
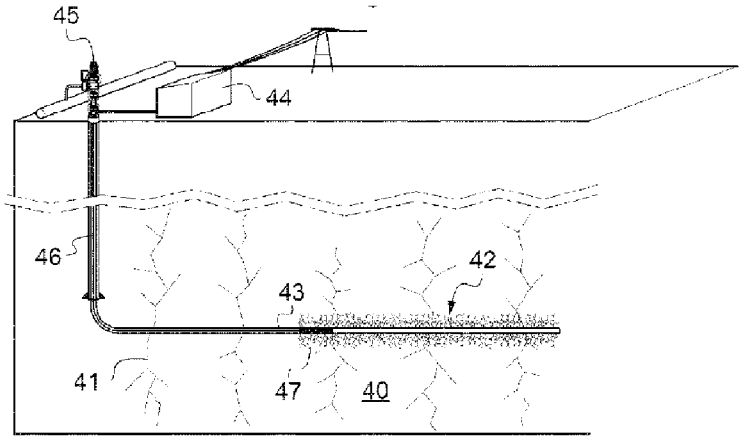
Figure 23:
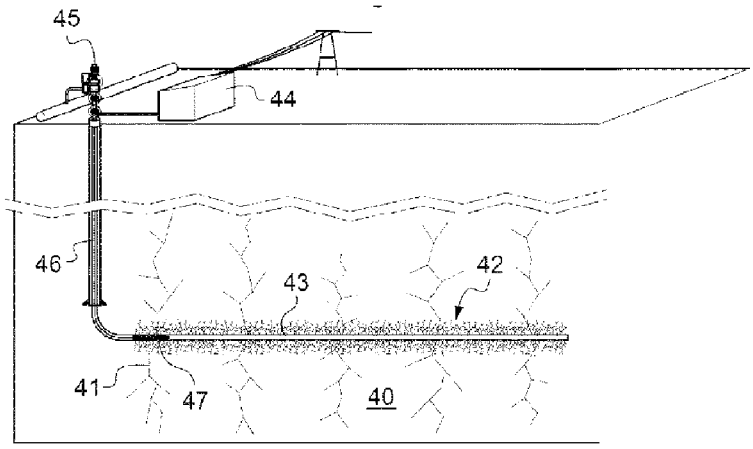

An example of electric fracturing (S10) in the fracturing method according to any of FIGS. 18 to 20 will now be described with reference to FIGS. 21 to 23. In this example, electric fracturing (S10) is carried out in a reservoir 40 in which a horizontal well 43 has been drilled. Electric fracturing (S10) here is combined with static fracturing, not specifically illustrated and optionally performed previously, which has formed main fractures 41 in the reservoir. The fracturing method here allows the production of hydrocarbons by means of a production pipe located on the surface at the head of the well 45. The electric arc is generated here at a fracturing device 47 which may conform to the fracturing device 100 in FIG. 1.

Figure 21:
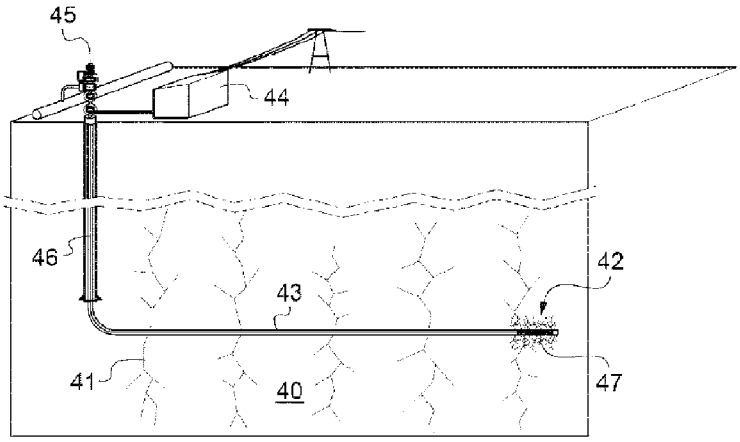
FIGS. 21 to 23, an example of electric fracturing in the fracturing method shown in any of FIGS. 18 to 20.

In the example of FIGS. 21 to 3, electric fracturing (S10) causes secondary fractures 42 at the point where the arc is generated. In the example, the secondary fractures 42 are shorter but more diffuse than the main fractures 41. In this example, electric fracturing (S10) is repeated at different treatment zones along the length of the well. FIG. 21 shows an initial phase of electric fracturing (S10) at the bottom of the well. FIG. 22 shows an intermediate phase in the centre of the well. And FIG. 23 shows a final phase at the head of the well. The progression of the secondary fractures 42 can be observed during the repeats of electric fracturing. The secondary fractures 42 are therefore dispersed all around the well 43. It is then possible to recover the hydrocarbon surrounding these secondary fractures 42, a hydrocarbon that potentially lies distant from the main fractures 41 and is therefore difficult to recover by static fracturing alone.

The mobility of the fracturing device 47, which may be the particular device, allows fracturing of the reservoir along the entire length of the well. In this example the device 47 is powered by a high voltage supply 44 located on the surface and connected to the device 47 by cables 46.

Evidently, the present invention is not limited to the described and illustrated examples, but can undergo numerous variants accessible to persons skilled in the art. For example, the principles set forth above can be applied to the production of seismic data. The generation of the electric arc could alternatively induce a pressure wave having lower characteristics than those needed for reservoir fracturing. This can be achieved for example by adapting the charge voltage of the fracturing device and the charge voltage, and by acting on inductance. A said method for producing seismic data may then comprise the receiving of a reflection of the pressure wave, the reflected wave then being typically modulated when passing through the constituent material of the reservoir. The method for producing seismic data may then also comprise the analysis of the reflected wave to determine the characteristics of the reservoir. A seismic survey can then be recorded on the basis of received data.

The invention claimed is:

1. A device for fracturing a geological hydrocarbon reservoir wherein the device comprises:

two packers defining a confined space therebetween in a well drilled in the reservoir;

an apparatus to regulate the temperature of a fluid in the confined space;

a pair of two electrodes arranged in the confined space; and an electric circuit to generate an electric arc between the two electrodes, the circuit comprising at least one voltage source connected to the electrodes and an inductor coil between the voltage source and one of the two electrodes;

wherein the circuit further comprises a Marx generator connected between the voltage source and the inductor, and the Marx generator having a spark gap that is primed by a pulse generator.

2. The device according to claim 1, wherein the temperature regulating apparatus regulates the temperature of the fluid to optimise the energy yield of the pre-discharge phase at the time of electric arc generation.

3. The device according to claim 2, wherein the temperature regulating apparatus holds the temperature of the fluid at a value between 45 and 67° C.

4. The device according to claim 3, wherein the device further comprises an apparatus for regulating the pressure of the fluid at atmospheric pressure.

5. The device according to claim 1, wherein the temperature regulating apparatus comprises a fluid cooling system.

6. The device according to claim 1, wherein the inductor coil has adjustable inductance between 1 μH and 100 mH.

7. The device according to claim 1, wherein a distance between the two electrodes is adjustable between 0.2 and 5 cm.

8. The device according to claim 1, wherein the voltage source comprises a capacitor having capacitance higher than 1 μF.

9. The device according to claim 8, wherein the capacitance of the capacitor is adjustable to a value lower than 200 μF.

10. The device according to claim 1, wherein the electrodes have a radius of between 0.1 mm and 50 mm.

11. The device according to claim 1, further comprising a release system.

12. The device according to claim 1, further comprising several pairs of the electrodes.

13. The device according to claim 1, wherein the inductor has an adjustable inductance.

14. A device for fracturing a geological hydrocarbon reservoir wherein the device comprises:

two packers defining a confined space therebetween in a well drilled in the reservoir;

an apparatus to regulate the temperature of a fluid in the confined space;

a pair of two electrodes arranged in the confined space; and an electric circuit to generate an electric arc between the two electrodes, the circuit comprising at least one voltage source connected to the electrodes and an inductor coil between the voltage source and one of the two electrodes, the voltage source comprising a capacitor, wherein the circuit further comprises a Marx generator and ferrites forming a saturable inductor on a pathway leading the capacitor directly to the inductor, the ferrites being saturated once the Marx generator is discharged.

15. The device according to claim 14, wherein the Marx generator has a spark gap that is primed by a pulse generator.

16. A device for fracturing a geological hydrocarbon reservoir wherein the device comprises:

two packers defining a confined space therebetween in a well drilled in the reservoir;

an apparatus to regulate the temperature of a fluid in the confined space;

a pair of two electrodes arranged in the confined space; and an electric circuit to generate an electric arc between the two electrodes, the circuit comprising at least one voltage source connected to the electrodes and an inductor coil between the voltage source and one of the two electrodes, the voltage source comprising a capacitor, wherein the capacitor is separated from the inductor by a spark gap primed by a pulse generator.

17. The device according to claim 16, wherein the circuit further comprises a Marx generator and ferrites forming a saturable inductor on a pathway leading the capacitor directly to the inductor.

18. The device according to claim 17, wherein the spark gap is disposed in the pathway between the ferrites and the inductor.

19. A method for calibrating a temperature regulator of a device comprising:

packers defining a confined space therebetween in a well drilled in a reservoir;

the temperature regulator, which regulates the temperature of a fluid in the confined space;

electrodes in the confined space; and an electric circuit generating an electric arc between the electrodes, the circuit comprising at least one voltage source connected to the electrodes and an inductor coil between the voltage source and one of the electrodes, the method comprising:

determining a pre-breakdown voltage above which the electric arc is generated; then measuring a breakdown voltage at terminals of the electrodes and a breakdown time as a function of the temperature of the fluid, by applying the pre-breakdown voltage and varying the temperature of the fluid;

inferring from the preceding step the energy yield of the pre-discharge phase as a function of the temperature; then defining a target temperature or temperature range for the temperature regulating apparatus as a function of the maximum energy yield inferred at the preceding step.

* * * * *